US007316345B2

(12) United States Patent
Sultana

(10) Patent No.: US 7,316,345 B2
(45) Date of Patent: Jan. 8, 2008

(54) DESKTOP CHANGE HOLDER AND WALL MOUNT

(75) Inventor: David V. Sultana, Park Ridge, IL (US)

(73) Assignee: BankaBank LLC, Park Ridge, IL (US)

( * ) Notice: Subject to any disclaimer, the term of this patent is extended or adjusted under 35 U.S.C. 154(b) by 0 days.

(21) Appl. No.: 11/348,164

(22) Filed: Feb. 6, 2006

(65) Prior Publication Data

US 2006/0185988 A1 Aug. 24, 2006

Related U.S. Application Data

(60) Provisional application No. 60/651,057, filed on Feb. 8, 2005.

(51) Int. Cl.
*A47G 29/00* (2006.01)

(52) U.S. Cl. ..... 232/4 R; 232/1 D; 206/815; 446/8; 109/50

(58) Field of Classification Search ..... 232/4 R, 232/1 D; D99/34; 206/0.815; 446/8; 150/150; 220/481, 476, 628; 109/50
See application file for complete search history.

(56) References Cited

U.S. PATENT DOCUMENTS

| | | | | |
|---|---|---|---|---|
| 569,675 | A | | 10/1896 | Seiler |
| D44,657 | S | | 9/1913 | Brunhell |
| 2,196,356 | A | * | 4/1940 | De Sipio et al. ..... 222/162 |
| 2,225,623 | A | | 12/1940 | Crawford |
| 2,427,763 | A | * | 9/1947 | Carper ..... 232/4 R |
| D183,094 | S | * | 6/1958 | Heath et al. ..... D99/34 |
| 3,361,142 | A | | 1/1968 | Shelton et al. |
| 4,088,250 | A | * | 5/1978 | Schaefer ..... 224/235 |
| 4,450,975 | A | * | 5/1984 | Glass et al. ..... 220/481 |
| 5,170,907 | A | * | 12/1992 | Sakai ..... 220/481 |
| 5,870,969 | A | * | 2/1999 | Boyce ..... 119/61.3 |
| D409,352 | S | * | 5/1999 | Nolte et al. ..... D99/28 |
| D423,267 | S | | 4/2000 | Roth et al. |
| 6,547,109 | B1 | | 4/2003 | Kim |
| D493,939 | S | | 8/2004 | Baumhogger et al. |
| D504,549 | S | | 4/2005 | Sultana |

* cited by examiner

*Primary Examiner*—William Miller
(74) *Attorney, Agent, or Firm*—Brooks Kushman P.C.

(57) ABSTRACT

The present invention provides a bank storage unit that may be supported and/or mounted to a bank holder to allow a user to store the bank storage unit to any vertical surface. The holster includes one or more support strips that may present a surface to support the bank storage unit. To sufficiently secure the bank storage unit to the bank storage holder, a first height of the support strips may be implemented at a height less than the second height of the first edge of the holster.

20 Claims, 6 Drawing Sheets

DESKTOP CHANGE HOLDER AND WALL MOUNT

CROSS-REFERENCES TO RELATED APPLICATIONS

This application claims priority to U.S. Provisional Application Ser. No. 60/651,057, filed Feb. 8, 2005 which is hereby incorporated by reference.

FIELD OF THE INVENTION

The present invention relates to banks for storing coins or other like items. More specifically, the present invention provides a wall mount for supporting the bank on a vertical surface.

DESCRIPTION OF THE RELATED ART

Bank storage units have been known for some time. Bank storage units are commonly known as piggy banks or coin holders and are used primarily by children. At times, bank storage units have been used by adults for storing loose change. These piggy banks are used as a means for teaching children money saving skills in addition to providing a hassle free mechanism for storing loose change for adults. Although piggy banks have proved worthy in terms of their utility, piggy banks have long been considered as items normally intended for use by children. A need exists for a bank storage unit that caters to the needs and lifestyles of both children and adults alike. It would be desirable to provide a bank storage unit that is easily adapted to be positioned or rest on any flat surface, in addition to, for security or convenience purposes, a bank storage unit that may be mounted to any wall or door for stowing or concealing the bank storage unit.

BRIEF SUMMARY OF THE INVENTION AND ADVANTAGES

It is the object of the present invention to provide a bank storage unit that is configured for placement on any flat surface or on a bank holder. The bank holder may slideably receive the bank storage unit to stow or conceal the bank storage unit on a vertical surface when desired. A further object of the present invention allows the user to decorate a wall with a decorative bank storage unit when placed on the bank holder. The user may also place the bank storage unit and bank holder on the back of a door for concealing the bank storage unit.

Additionally, a user can position the bank storage unit on the bank holder near any appliance or device that utilizes coin consumption for operation. The bank storage unit is also configured to allow a user to place the bank storage unit on any horizontal surface. The bank storage unit and the bank holder may also include various decorative themes that target adult interests. Likewise, the decorative themes may vary for targeting child consumption while maintaining its main objective in providing for overall utility for adult users.

BRIEF DESCRIPTION OF THE SEVERAL VIEWS OF THE DRAWINGS

Other advantages of the present invention will be readily appreciated as the present invention becomes better understood by reference to the following detailed description when considered in connection with the accompanying drawings wherein.

DETAILED DESCRIPTION OF THE INVENTION

Figure 1:
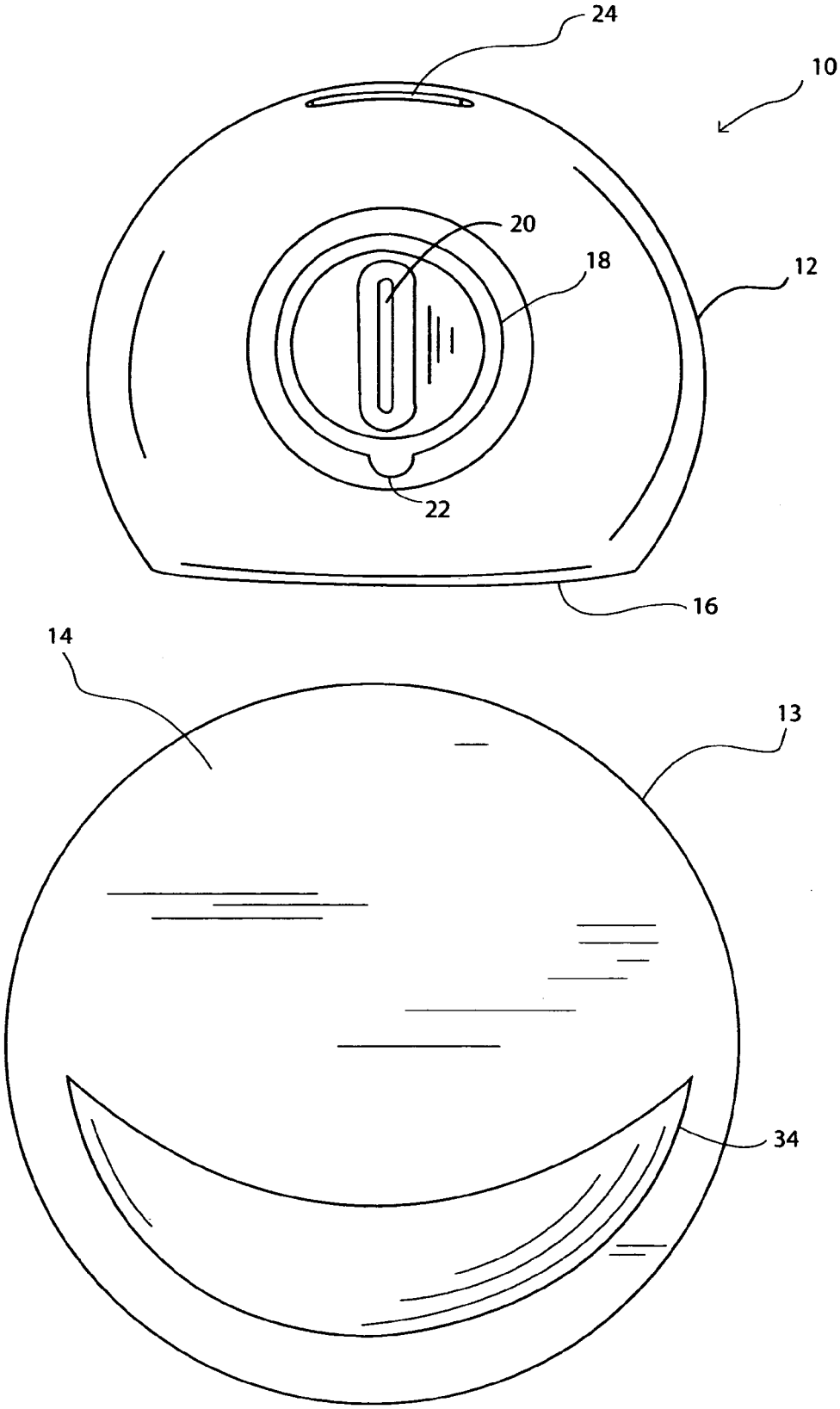
FIG. 1 is an exploded view of a bank assembly.

Referring to the FIG. 1, a bank assembly is generally shown at 10 and comprises a bank storage unit 12 and a bank storage holder 13. The bank storage unit 12 is generally shaped in the form of a semi circle. The bank storage unit 12 may be adapted to any number of shapes and sizes. The particular implementation of the bank storage unit 12 may be varied based on a particular implementation. A flat surface portion 16 is disposed at one end of the bank storage unit 12. When the bank storage unit 12 is positioned on any flat surface, the flat surface portion 16 abuts the flat surface (or horizontal surface). The bank storage unit 12 defines a cavity formed therein for storing a plurality of coins or any like item.

An access tab 18 is removably coupled to the bank storage unit 12. The access tab 18 may be removed to allow the user to empty the contents of the bank storage unit 12 with relative ease. A first slot 20 may be formed within the access tab 18 to allow a user to insert coins in a horizontal direction with the bank storage unit 12. The access tab 18 may be made of soft rubber or plastic (or any flexible material) to facilitate removal and insertion. A tab 22 is integrally formed with the access tab 18 to allow the user to grasp the access tab 18 during the removal and insertion operation. A second slot 24 may be formed on the bank storage unit 12 to allow the user to insert change in a downward vertical direction. The second slot 24 provides the user with an alternate location to insert coins.

The bank storage holder 13 generally comprises a bank holder 14 and a holster 34. The holster 34 is integrally formed with the bank holder 14. The bank storage holder 13 slideably receives and supports the bank storage unit 12.

Figure 2:
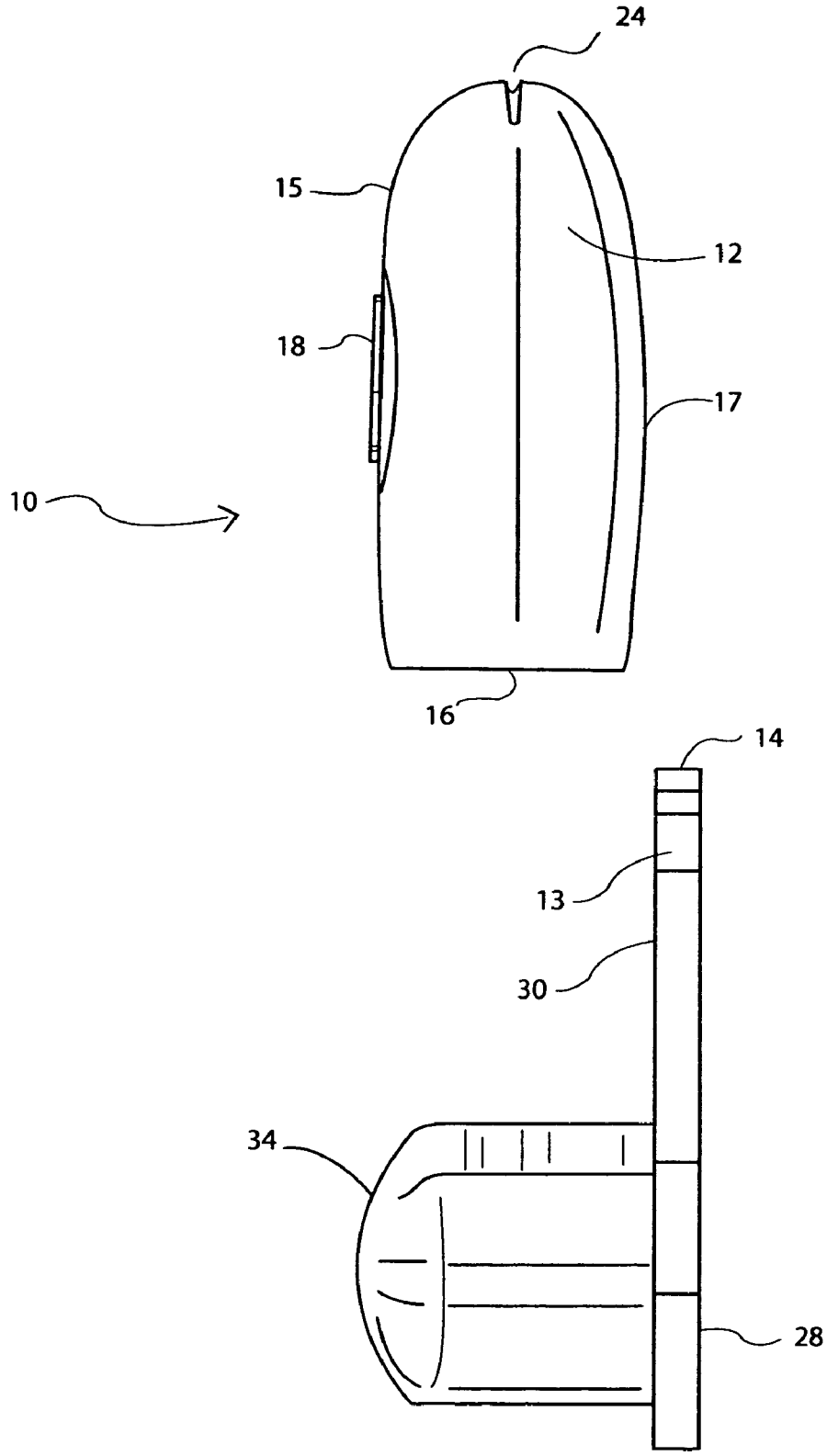
FIG. 2 is a side exploded view of the bank assembly.

Referring to FIG. 2, a side view of the bank storage unit 12 and the bank storage holder 13 is shown. The bank storage unit 12 comprises a first side 15 and a second side 17. The access tab 18 is disposed on the first side 15. FIG. 2 illustrates that the first side 15 generally faces the user. The bank storage holder 13 comprises a first side 28 and a second side 30. When the bank storage holder 13 is coupled to a vertical surface (e.g., a wall or door), the first side 28 of the bank storage holder 13 is positioned adjacent the vertical surface.

Figure 3:
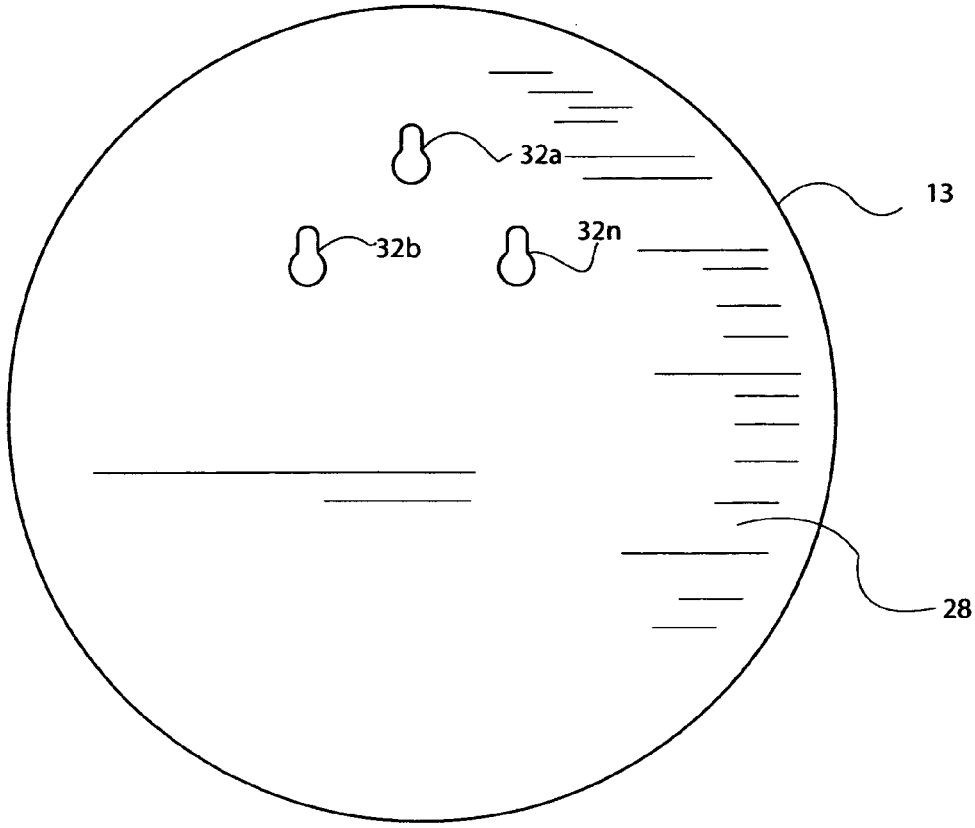
FIG. 3 is a rear view of the bank storage holder.

Referring to FIG. 3, a back view of the bank storage holder 13 is shown. The bank storage holder 13 comprises a plurality of mounting holes 32*a*-32*n*. The mounting holes 32*a*-32*n* allow the bank storage holder 13 to be coupled to the vertical surface. The mounting holes 32*a*-32*n* may receive the head of a nail or screw to couple the bank storage holder 13 to the vertical surface. The bank storage unit 12, the bank holder 14, the holster 34 and the support strips

40*a*-40*n* may be constructed from plastic, stainless steel, silicon, pewter, wood and/or ceramic.

Figure 4:
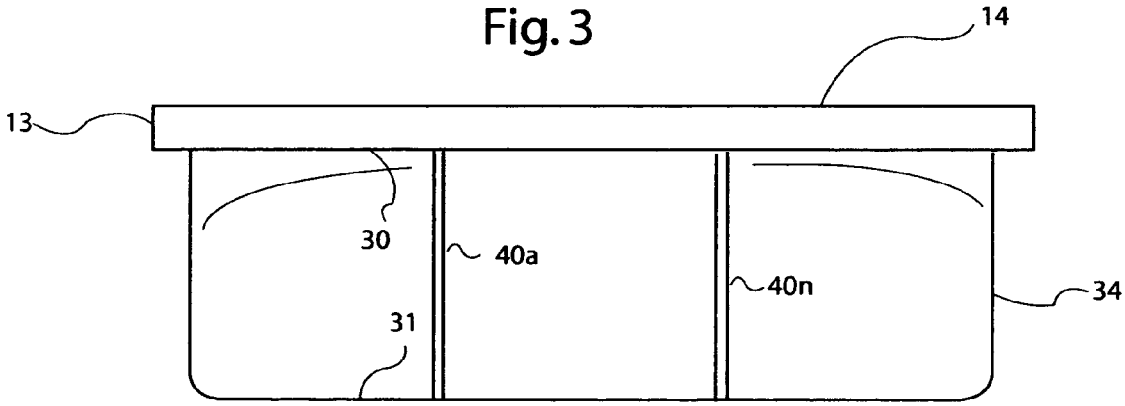
FIG. 4 is a top view of a bank holder, a holster, and one or more support strips in accordance with the present invention.

Referring to FIG. 4, a top view of the holster 34 is shown. The holster 34 comprises one or more support strips 40*a*-40*n*. The support strips 40*a*-40*n* are axially spaced and parallel to one another. Each support strip 40*a*-40*n* may be configured to have a similar height relative to each other. However, other embodiments may include support strips 40*a*-40*n* that have different heights from each other. The height of the support strips may 40*a*-40*n* may be varied to meet a particular implementation. The holster 34 includes an inner wall 31. The support strips 40*a*-40*n* extend between the second side 30 of the bank holder 14 and the inner wall 31 of the holster 34.

Figure 5:
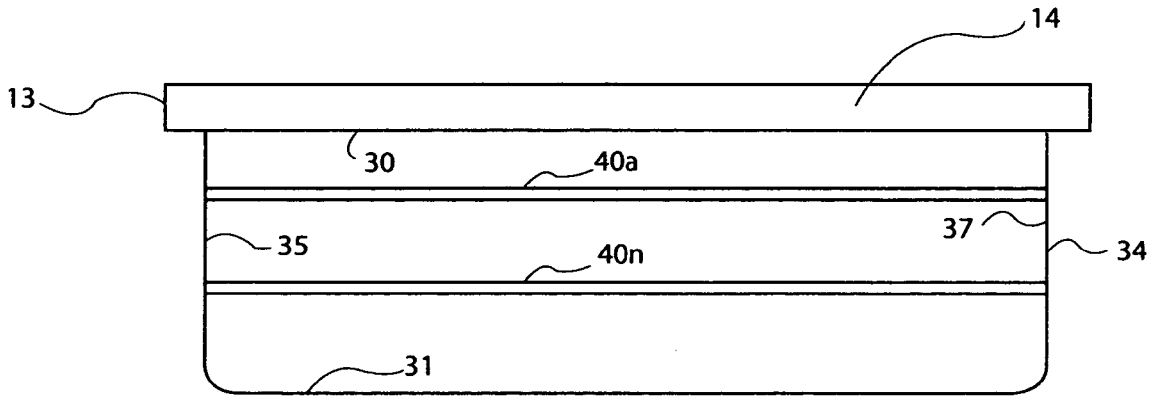
FIG. 5 is a top view of the holster and the support strips in accordance with another embodiment.

Referring to FIG. 5, a top view of another embodiment of the holster 34 is shown. The holster 34 comprises a first portion 35 and a second portion 37. The support strips 40*a*-40*n* extend between the first portion 35 and the second portion 37. In reference to the implementation of the support strips 40*a*-40*n* as shown in FIGS. 4-5, it may be possible to implement a single support strip to support the bank storage unit 12. With such an implementation, the support strip may be centered within the holster 34 and extend between the first side 30 of the bank holder 14 and the lip portion 31 of the holster 34 to sufficiently support the bank storage unit 12. The support strips 40*a*-40*n* may be implemented in a number of arrangements. The support strips 40*a*-40*n* may be arranged in a crossing pattern with each other. The arrangement of the support strips 40*a*-40*n* may be varied to meet the design criteria of a particular implementation.

Figure 6:
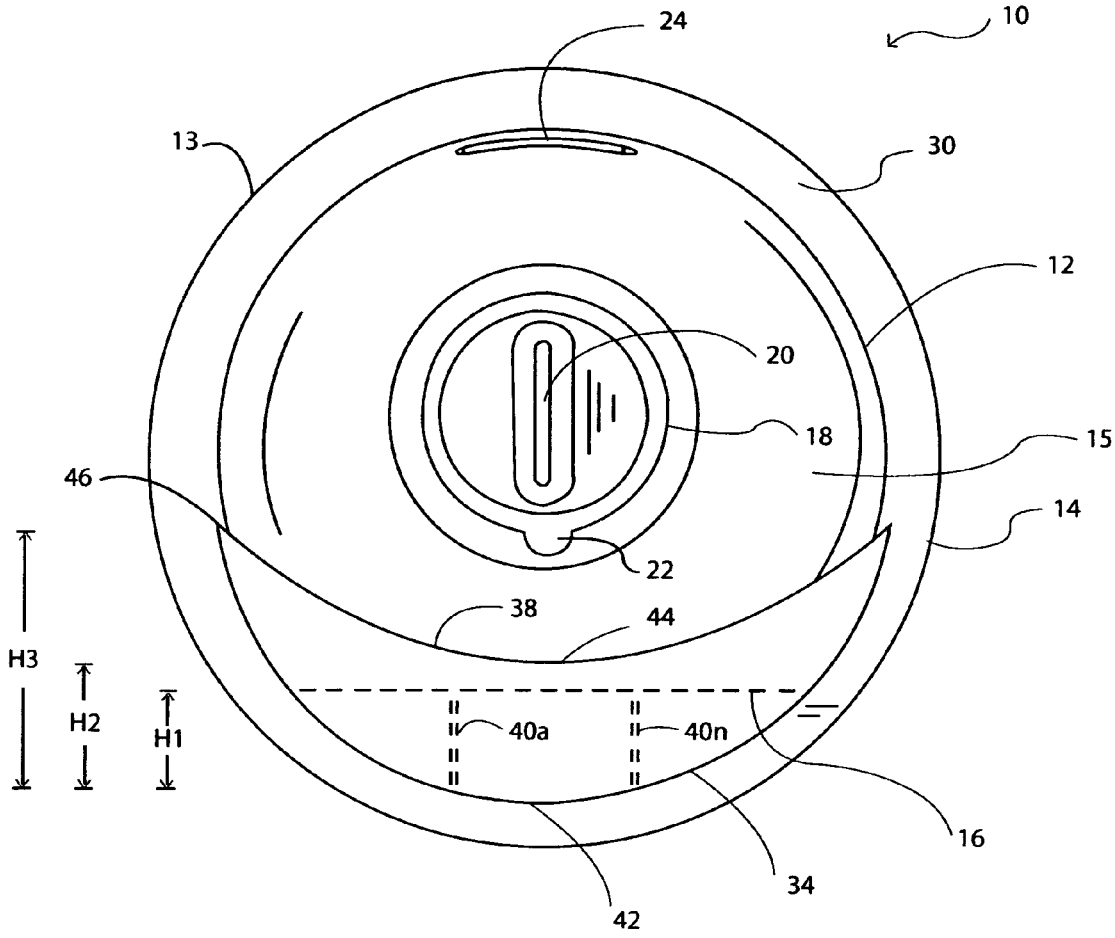
FIG. 6 is a view of the bank storage unit positioned on bank storage holder in accordance with the present invention.

Referring to FIG. 6, a front view of the bank storage unit 12 positioned on bank storage holder 13 is shown. The holster 34 slideably receives and supports the bank storage unit 12. The flat surface portion 16 of the bank storage unit 12 abuts the support strips 40*a*-40*n*. A portion of the first side 15 of the bank storage unit 12 abuts an inner wall 31 of the holster 34. The second side 17 (not shown) of the bank storage unit 12 abuts the second side 30 of the bank holder 14. The bank holder 14 in combination with the holster 34 is generally configured to securely support the bank storage unit 12. The holster 34 includes a first edge 38 (or top edge of the holster in reference to the orientation of the bank assembly as shown in FIG. 6). The first edge 38 may be curved in a downward orientation to form a circumferential lip across the holster 34. In one example, the first edge 38 may be implemented as a straight line from one end of the holster 34 to another end of the holster 34. The support strips 40*a*-40*n* may be defined by a first height H1. The first height H1 is the length of between the bottom of the support strips 40*a*-40*n* and the top of the support strips 40*a*-40*n*. The first edge 38 may be defined by a second height H2 and a third height H3. The second height H2 is the length between a bottom portion 42 of the holster 34 and a center 44 of the first edge 38. The third height H3 is the length between the bottom portion 42 of the holster 34 an upper portion 46 of the holster 34. To sufficiently secure the bank storage unit 12 to the bank storage holder 13, the first height H1 of the support strips 40*a*-40*n* should be less than the second height H2 of the first edge 38. Such a configuration will ensure that the bank storage unit 12 will not fall forward or off of the bank storage holder 13 if the vertical surface (on which the bank assembly may be coupled to) is not exactly 90 degrees. The height H1, H2 and H3 may be varied to meet the design criteria of a particular implementation.

Figure 7:
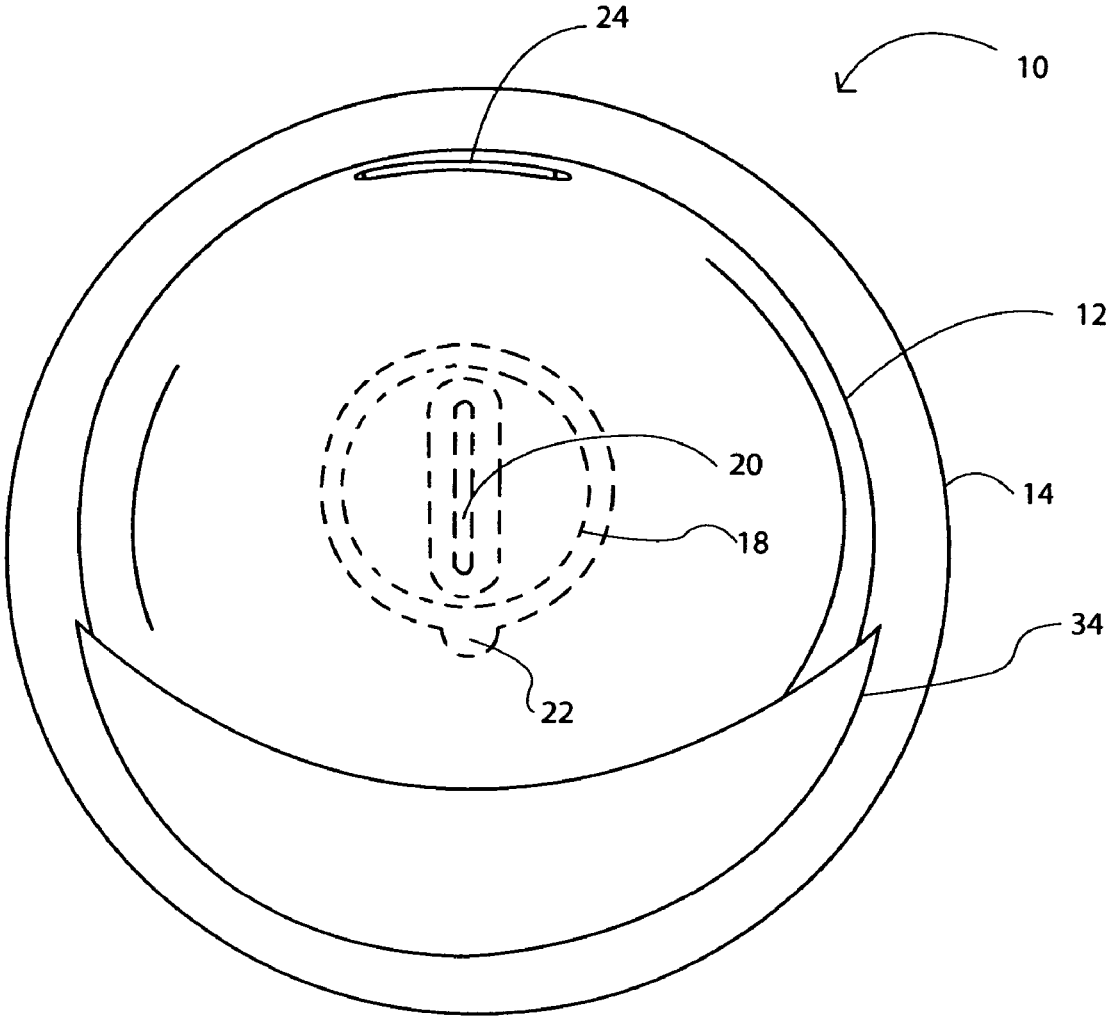
FIG. 7 is a view of the bank storage unit positioned on bank storage holder in accordance with another embodiment.

Referring to FIG. 7, a front view of the bank assembly 10 illustrates the bank storage unit positioned on the bank holder one hundred and eighty degrees from the position of the bank storage unit as shown in FIG. 6. The holster 34 and the bank holder 14 may be configured to support the bank storage unit 12 when the second side 17 of the bank storage unit 12 is positioned to face away from the vertical surface and toward the user. Such a configuration may allow a manufacturer to decorate the surface area of the second side 17 of the bank storage unit 12. Adult and children themes may be used to decorate the bank assembly to attract consumers.

While not illustrated, the bank assembly may be implemented without support strips 40*a*-40*n*. In one example, the holster may be formed in the shape of a rectangle having a cavity therebetween for supportably receiving the bank storage unit 12. Such a holster may supportably receive a bank storage unit 12 shaped in the form of a semi-circle or in the form of a rectangle. The shape of the bank storage unit 12 and the holster 34 may be implemented to form a number of interlocking shapes and/or forms to allow the bank storage holder 13 to adequately support the bank storage unit 12.

The invention has been described in an illustrative manner, and it is to be understood that the terminology which has been used is intended to be in the nature of words of description rather than of limitation. As is now apparent to those skilled in the art, many modifications and variations of the present invention are possible in light of the above teachings. It is, therefore, to be understood that the invention may be practiced otherwise than as specifically described.

What is claimed is:

1. A bank assembly comprising of:

a bank storage unit defining a cavity therein for storing coins;

a bank holder coupled to a vertical surface to support said bank storage unit; and a holster disposed about said bank holder, said holster defining an interior volume with a closed bottom portion, said holster having one or more support strips within said interior volume, wherein said holster and said support strips slideably receives and supports said bank storage unit.

2. The bank assembly of claim 1, wherein said support strips are axially spaced from each other.

3. The bank assembly of claim 1, wherein said bank storage unit includes a first side, a second side and a flat surface portion.

4. The bank assembly of claim 3, wherein said bank storage unit further comprises an access tab disposed on one of said first side of said bank storage unit, said second side of said bank storage unit and said flat surface portion of said bank storage unit.

5. The bank assembly of claim 4, wherein said access tab is removably coupled to one of said flat surface portion, said first side of said bank storage unit, and said second side of said bank storage unit.

6. The bank assembly of claim 4, wherein said access tab is made of soft plastic.

7. The bank assembly of claim 4, wherein said access tab is rubber.

8. The bank assembly of claim 1, wherein said bank storage unit is shaped in a semi-circle.

9. The bank assembly of claim 1, wherein said bank storage unit, said bank holder, said holster and support strips are constructed from a group consisting of plastic, stainless steel, silicon, pewter, wood and ceramic.

10. The bank assembly of claim 1, wherein said bank storage unit comprises a first opening to receive coins.

11. The bank assembly of claim 10, wherein said bank storage unit comprises an access tab defining a second opening to receive coins.

12. The bank assembly of claim 1, wherein said holster, said bank holder and said support strips are integrally formed into a single piece.

13. The bank assembly of claim 1, wherein said holster includes a first portion, a second portion, an inner wall, and a first edge and said bank holder includes first and second sides.

14. The bank assembly of claim 13, wherein said support strips extend between said first portion of said holster and said second portion of said holster.

15. The bank assembly of claim 13, wherein said support strips extend between said second side of said bank holder and said inner wall of said holster.

16. The bank assembly of claims 15, wherein said support strips are positioned at a first height in relation to said holster.

17. The bank assembly of claim 16, wherein said first edge of said holster is positioned at a second height, and said second height is greater in height than said first height.

18. A bank assembly comprising:

bank storage means for storing coins;

bank holder means for supporting said bank storage means and coupled to a vertical surface; and holster means disposed about said holder means, said holster means defining an interior volume with a closed bottom portion, said holster means having one or more support strips means within said interior volume for receiving and supporting said bank storage means.

19. A bank assembly comprising of:

a bank storage unit defining a cavity therein for storing money;

a bank holder coupled to a vertical surface; and a holster disposed about said bank holder, said holster defining an interior volume with a closed bottom portion, said holster having one or more support strips within said interior volume, wherein said bank holder, said holster and said support strips coact with each other to support said bank storage unit and position said bank storage unit about said vertical surface.

20. The bank assembly of claim 19, wherein said support strips are parallel to each other.

* * * * *